US006471014B1

(12) United States Patent
Daniel et al.

(10) Patent No.: US 6,471,014 B1
(45) Date of Patent: Oct. 29, 2002

(54) ELEVATOR INSTALLATION WITH A DEVICE FOR OPERATING IN A SPECIAL MODE

(75) Inventors: Christian Daniel, Hildrizhausen; Ulrich Haeberle, Stuttgart; Hubert Erker, Gingen; Holger Zerelles, Leinfelden Echterdingen, all of (DE)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/806,116

(22) PCT Filed: Sep. 27, 1999

(86) PCT No.: PCT/CH99/00457

§ 371 (c)(1),
(2), (4) Date: Mar. 28, 2001

(87) PCT Pub. No.: WO00/18676

PCT Pub. Date: Apr. 6, 2000

(30) Foreign Application Priority Data

Sep. 28, 1998 (DE) ..... 298 17 351 U

(51) Int. Cl.[7] ..... B66B 3/00
(52) U.S. Cl. ..... 187/391; 187/399; 187/290
(58) Field of Search ..... 187/289, 290, 187/391, 277, 393, 397, 399

(56) References Cited

U.S. PATENT DOCUMENTS

| | | | | | |
|---|---|---|---|---|---|
| 3,973,648 | A | * | 8/1976 | Hummert et al. | 187/29 |
| 5,387,769 | A | * | 2/1995 | Kupersmith et al. | 187/248 |
| 5,557,546 | A | * | 9/1996 | Fukai et al. | 364/555.01 |
| 5,787,020 | A | * | 7/1998 | Molliere et al. | 364/550 |
| 6,269,911 | B1 | * | 8/2001 | Richter | 187/289 |
| 6,330,935 | B1 | * | 12/2001 | Systermans | 187/391 |

FOREIGN PATENT DOCUMENTS

| | | | |
|---|---|---|---|
| JP | 405162934 A | * | 5/1993 |
| JP | 405246639 A | * | 5/1993 |

* cited by examiner

*Primary Examiner*—Jonathan Salata
(74) *Attorney, Agent, or Firm*—Cohen, Pontani, Lieberman & Pavane

(57) ABSTRACT

The invention relates to a device for operating elevators in a special mode which comprises at least one control element for controlling at least one allocated functional unit of the elevator. At least one indicator is assigned to the functional unit, which indicates at least one condition of the functional unit that can be influenced by one or several control elements and which can be perceived by the operator of the one or several control elements.

8 Claims, 2 Drawing Sheets

ELEVATOR INSTALLATION WITH A DEVICE FOR OPERATING IN A SPECIAL MODE

PRIORITY CLAIM

This is a U.S. national stage of application No. PCT/CH99/00457, filed on Sep. 27, 1999. Priority is claimed on that application and on the following application(s): Country: Germany, Application No.: G 298 17 351.4 U, Filed: Sep. 28, 1998.

BACKGROUND OF THE INVENTION

The invention relates to an elevator installation with a device for operating elevator installations in a special mode which has at least one control element for controlling at least one allocated functional unit of the elevator installation. The functional unit has assigned to it at least one indicating device which indicates at least one condition of the functional unit able to be influenced by the control element or elements, and which can be perceived by the operator of the control element or elements.

When operating elevators in special modes, i.e. in emergencies, when commissioning, acceptance testing, or handing over, during maintenance, or in other modes of operation of the elevator installation other than the normal mode, technical personnel have to take special measures on the elevator installation. For this purpose, corresponding control elements are required to control the individual functional units of the installation.

Known devices for operating elevator installations in special modes have in common that the respective control elements are arranged so that the elevator installation, and/or the functional units to be controlled, can be seen from them. The associated indicating devices are also arranged where they can be seen from the control elements, and are therefore connected to the elevator installation and/or its functional units. For example, from the prior publication DE 296 15 921 U1 a device of this category is known by means of which the brake of an elevator machine can be controlled when the respective elevator installation is operated in a special mode. For this purpose a control element is provided which takes the form of a hand lever which is accommodated in the immediate vicinity of a window inserted in the wall of the elevator hoistway and which by being caused to pivot can be used to release the brake of the elevator machine, and after releasing it, to activate it again. When doing so, the operator has direct visual contact with the drive wheel of the elevator machine as well as with the elevator ropes. As a result, the drive wheel and the elevator ropes can take on the function of indicating devices for the operating condition of the brake of the elevator machine. According to the prior publication DE 296 15 921 U1 it is essential for the hand lever to be installed from where the elevator machine and/or the elevator ropes, and therefore the elevator installation, can be seen. The known indicating devices, that is to say, the drive wheel of the elevator machine as well as the elevator ropes, are themselves functional units of the elevator installation.

Starting out from the state of the art according to DE 296 15 921 U1, the objective of the present invention is to permit flexibility with regard to planning and realization of elevator installations.

According to the invention, this objective is achieved in that in the case of a device of the type described above, the control element or elements, as well as the indicating device or devices, can be locationally arranged independent of the elevator installation and/or of the functional unit or units of the elevator installation allocated to them. Within the meaning of the invention, the control elements and indicating devices can be arranged at will at almost any location considered to be expedient. Correspondingly, operation of the associated elevator installation in a special mode is possible from almost any location chosen at will. Possibilities are, for example, a central control room of the building which is equipped with the elevator installation in question, the residence of the respective building's custodian, and/or the service center of a provider of services relating to the elevator installation. In these places, a number of devices according to the invention can be located together in one location, so that a number of elevator installations can be operated in special modes from, for example, one single control room. The device according to the invention is especially advantageous in relation to elevator installations which have no machine room allowing control elements and indicating devices of the type stated to be easily accommodated close to the elevator. In the case of elevator installations and/or their functional units which cannot be directly seen into by the operator, special provisions such as, for example, building measures like hoistway windows to enable visual contact of the operator with the elevator or the respective functional units can be dispensed with.

Preferred according to the invention is comprehensive remote operation and/or control of functional units of elevator installations operated in special modes. Accordingly, provided and arranged locationally independent of the elevator installation and/or of the allocated functional unit or units of the elevator installation as control element is, in particular, at least one control element to control the power supply of the elevator installation, and/or at least one control element to control the main drive of the elevator installation, and/or at least one control element to control the operating brake of the elevator installation, and/or at least one control element to control a door drive of a means of conveyance of the elevator installation, and/or at least one control element to control a safety device of the elevator installation, and/or at least one control element to control an auxiliary device for moving a means of conveyance of the elevator installation up and/or down, and/or at least one control element to control lighting of the car of the elevator installation, and/or at least one control element to control lighting of the hoistway of the elevator installation. Allocated to each control element is at least one indicating device which eliminates the need for direct visual contact with the elevator installation and/or the respective functional unit operated in a special mode.

Provided according to the invention to enable comprehensive remote monitoring of the effects of the control manipulations performed by means of the control element or elements on the condition of the respective functional units of the elevator installation with control elements arranged locationally independent of the elevator installation is, in particular, at least one indicating device indicating the switching status of the power supply of the elevator installation, and/or at least one indicating device indicating the movement condition of at least one, preferably all, functional units of the elevator installation moved when operating the elevator installation in a special mode, and/or at least one indicating device indicating the adjustment status of a drive control device, and/or at least one indicating device indicating the position of a means of conveyance of the elevator installation relative to an entrance in the building to the means of conveyance, and/or at least one indicating device indicating the operating condition of a safety device of the elevator installation, and/or at least one indicating device indicating the opening condition of the doors of the means of conveyance of the elevator installation, and/or at least one switching condition of lighting of the car of the elevator installation, and/or at least one indicating device indicating the switching condition of lighting of the hoistway of the elevator installation.

Simple operation is a characteristic of a variant of the device according to the invention for operating elevators in a special mode, should a number of control elements, preferably all control elements, be located together in one location. Such control elements, accommodated for example in a common housing, can be accessed by the operator in their entirety without the operator needing to change his position.

In the interest of optimal operating convenience, according to the invention it is also foreseen that at least one control element is located together in one control unit with the at least one assigned indicator. This arrangement of the control elements and indicating devices allows the operator to have them both in view without difficulty, and to monitor operation of the elevator installation in special mode while controlling it.

So as to be able to restrict the possibility of operating the elevator installation in a special mode to the group of persons authorized to do so, in a further development of the invention it is foreseen that the control element or elements, or the control unit if applicable, is or are lockable.

In a preferred exemplary embodiment of the device according to the invention, remote control and/or remote testing or remote monitoring of the elevator installation is realized by there being provided between at least one of the control element or elements and the functional unit or units of the elevator installation and the indicating device or devices, and/or between at least one of the functional element or elements of the elevator installation and the indicating device or devices, a wired control device for controlling at least one functional unit of the elevator installation and/or for controlling at least one indicating device.

BRIEF DESCRIPTION OF THE DRAWINGS

The invention is explained in greater detail below by reference to diagrammatic illustrations of an exemplary embodiment. The illustrations show.

DETAILED DESCRIPTION OF THE PREFERRED EMBODIMENTS

Figure 1:
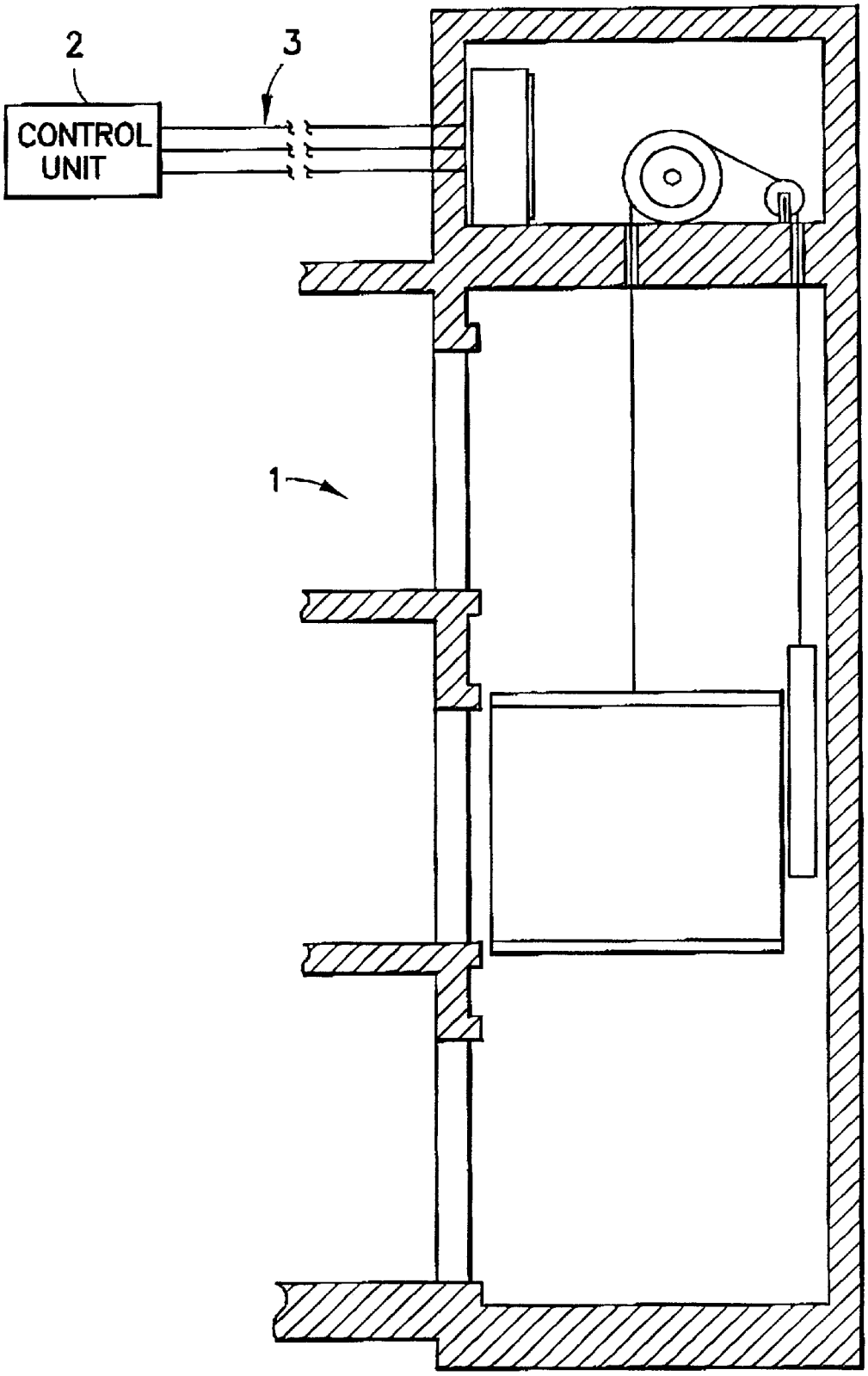
FIG. 1 The constructional principle of a device for operating elevators in a special mode with, among other things, a control unit.

According to FIG. 1, a device for operating elevators in a special mode comprises an elevator installation 1, a control unit 2, and an interface 3 via which the control unit 2 is in contact with the elevator installation 1 and/or with its functional units. The interface 3 has, among other things, electric conductors for supplying power to the functional units of the elevator installation 1 as well as binary signal conductors for the transmission of data by wired means between the elevator installation 1 and the control unit 2. Alternatively, data transmission by non-wired means is also possible.

Figure 2:
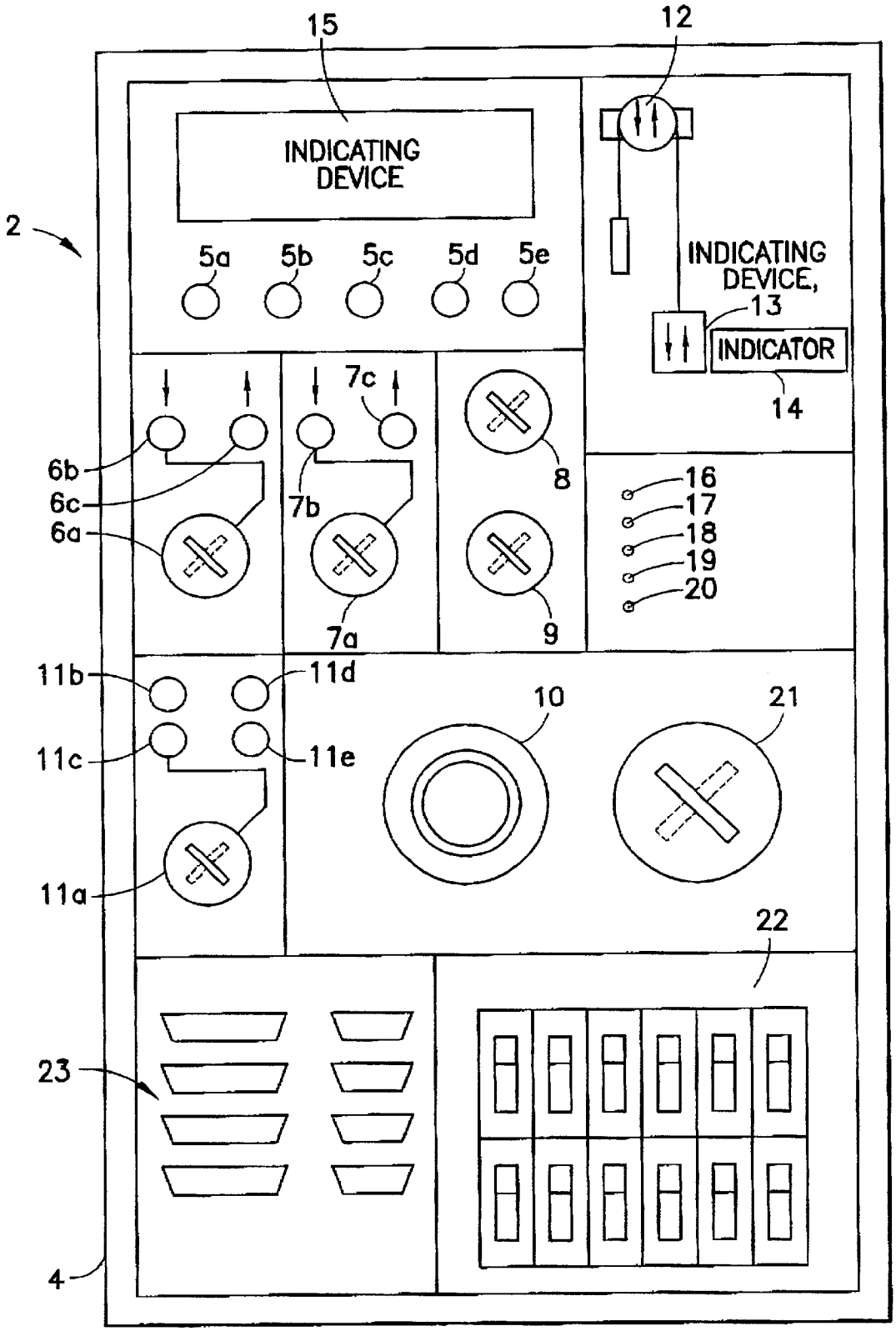
FIG. 2 The control unit according to FIG. 1 illustrated separately.

According to FIG. 2, a number of control elements and indicating devices are collected together in the control unit 2 and accommodated in a common housing 4. The individual control elements are:

Control elements 5*a*, 5*b*, 5*c*, 5*d*, 5*e* 6*a*, 6*b*, 6*c*, and 7*a*, 7*b*, 7*c*, all of which allow influence to be taken on a digital control of the elevator installation 1;

A control element 8 for the hoistway lighting of the elevator installation 1;

A control element 9 for the interior lighting of an elevator car serving as means of conveyance in the elevator installation 1;

A control element 10 for switching a safety circuit serving as safety device of the elevator installation 1;

Control elements 11*a*, 11*b*, 11*c*, 11*d*, 11*e* for controlling various functional units of the elevator installation 1 when in its test mode; and A control element 21 in the form of a main switch for controlling, in the sense of disconnecting or connecting, the power supply of the entire elevator installation 1 including the control unit 2.

The individual indicating devices provided are:

An indicating device 12 to indicate the movement condition and movement direction of the traction sheave of the elevator installation 1;

An indicating device 13 to indicate the movement condition and movement direction of the elevator car of the elevator installation 1;

An indicating device 14 to indicate the position of the elevator car relative to an entrance in the building in the form of a hoistway door of the elevator installation 1;

An indicating device 15;

An indicating device 16 to indicate the test condition of the safety circuit of the elevator installation 1;

An indicating device 17 to indicate the switching position of limit switches of the elevator installation An indicating device 18 to indicate the opening condition of the doors of the elevator car;

An indicating device 19 to indicate the locking condition of the hoistway doors of the elevator installation 1; and An indicating device 20 to indicate the readiness for travel of the elevator installation 1.

In addition, the control elements 8, 9, 10, and 21 themselves also serve as indicating devices. Thus, the positions to which the respective control elements 8, 9, 21 are turned, and the position in which the control element 10 is pressed, indicate which condition the associated functional units of the elevator installation 1 are in.

Integrated into the housing 4 of the control unit 2, in addition to the components listed above, are fuses 22 and possibilities for connection 23. The latter can be used in case of emergency, for example, to connect an emergency power supply to the elevator installation 1. If the elevator installation 1 has an electronic memory for error messages, this can be read out by maintenance, test, and/or repair personnel via one the possibilities for connection 23 using a corresponding auxiliary device as, for example, a laptop.

So that use of the control unit 2 to operate the elevator installation 1 in a special mode can be restricted to the group of persons authorized to do so, the control unit 2 is lockable.

By pressing one or more of the control elements 5*a*, 5*b*, 5*c*, 5*d*, 5*e*, control data stored in the digital control of the elevator installation 1 can be called up and—if so desired—modified both for the regular and special modes of operation of the elevator installation 1. Serving as indicating device for the called-up data is the indicating device 15 which, as a display in conjunction with the control elements 5*a,* 5*b,* 5*c,* 5*d,* 5*e,* forms an interactive device for programming the elevator control. The control elements 5*a,* 5*b,* 5*c,* 5*d,* 5*e* can be used, for example, to influence the programming status of the main drive of the elevator installation 1. In this respect, the control elements 5*a,* 5*b,* 5*c,* 5*d,* 5*e* serve as devices for controlling the main drive of the elevator installation 1.

Actuation of the control elements 6*a,* 6*b,* 6*c,* 7*a,* 7*b,* 7*c* also acts via the elevator control on the respective functional units of the elevator installation 1. The recall function of the elevator control can be influenced by the control elements 6*a,* 6*b,* 6*c,* AND its emergency evacuation function can be influenced by the control elements 7*a,* 7*b,* 7*c.*

By turning the control element 6a into the position indicated in FIG. 2 by broken lines, the elevator control is put into recall mode. By pressing the control elements 6*b,* 6*c,* corresponding control of the main drive and the operating brakes of the rope-traction elevator installation controlled by the elevator control 2 causes the car of the elevator installation 1 to be lowered (control element 6*b*) or raised (control element 6*c*) relative to its momentary position. The movement condition and movement direction of the main drive or traction sheave, and/or of the elevator car of the elevator installation 1, can be discerned by reference to the indicating devices 12, 13.

By turning the control element 7*a* into the position indicated in FIG. 2 by broken lines, the elevator control is put into evacuation mode. When this has been done, by pressing control element 7*b* or control element 7*c,* an auxiliary drive and the operating brakes of the elevator installation 1 can be controlled in a manner to lower the elevator car (control element 7*b*) or to raise the elevator car (operating element 7*c*). In this case, too, the indicating device 13 serves to indicate the movement condition and direction of the elevator car.

Both the indicating device 14 and the indicating device 15 also take on display functions for recall control mode and evacuation. Thus, activation, i.e. illumination, of the indicating device 14 indicates that the floor of the elevator car is arranged level with the floor of a landing of the building equipped with the elevator installation 1, and that the elevator car can accordingly be left by the passengers. The indicating device 15 indicates the momentary height of the elevator car above the hoistway sill in millimeters.

By turning the control element 8 into the position indicated in FIG. 2 by broken lines, the hoistway lighting of the elevator installation 1 is switched on, by turning it into the position indicated in FIG. 2 by continuous lines, the hoistway lighting of the elevator installation 1 is switched off. Similarly, by turning the control element 9, the interior lighting of the elevator car can be switched on and off, by turning the control element 21 the power supply of the elevator installation 1 can be disconnected or connected.

Provided as a safety device for the elevator installation 1 is a so-called "safety circuit". Included in this safety circuit are various parts of the installation relevant for the operational safety of the elevator installation 1. In the exemplary case illustrated these are limit switches which limit the travel path of the elevator car above and below, and limit switches around the car doors and the hoistway doors of the elevator installation 1. The elevator installation 1 can only travel when the safety circuit is closed.

To interrupt the safety circuit, for example in emergencies while operating the elevator installation 1 in a special mode, the control element 10 can be pressed down from its initial position. The pressed position of the control element 10 therefore provides information as to whether the safety circuit is in the closed or interrupted condition.

With the safety circuit interrupted, the drive motor of the elevator installation 1 is disconnected from the power supply, and the operating brake is also switched to have no current flowing through it, so it is closed. Accordingly, the control element 10 serves to control both the main drive and the operating brake of the elevator installation 1. In the case of hydraulic elevator installations, an interruption of the safety circuit causes disconnection of the drive pump from the power supply and closure of the respective outflow valves.

Operation of the elevator installation 1 for travel following interruption of the safety circuit is preceded by its being checked for presence of the closed status.

Lighting up of the indicating device 16 indicates that the safety circuit is being correspondingly checked. If the indicating device 17 lights up, this signifies that no limit switches of the elevator installation 1 are activated. If the indicating device 18 lights up, the car doors are closed, and if the indicating device 19 lights up, the hoistway doors of the elevator installation 1 are closed. If, as well as the indicating devices 16, 17, 18, 19, the indicating device 20 also lights up, this indicates the readiness for travel of the elevator installation 1. The drive motor of the elevator installation 1 is then connected to the power supply, the operating brake has current flowing through it. In view of these interrelationships, the indicating devices 16, 17, 18, 19, 20 are also indirectly indicating devices for the operating condition of the main drive and the operating brake of the elevator installation 1.

The control of functional units of the elevator installation 1 for the purpose, for example, of testing by the authorities is the sole purpose served by the operating elements 11*a,* 11*b,* 11*c,* 11*d,* 11*e.* By turning the control element 11*a* into the position indicated in FIG. 2 by broken lines, the digital control of the elevator installation 1 is transferred into the testing mode. By then pressing the control elements 11*b,* 11*d,* the two circuits of the operating brake of the elevator installation 1, which are independent of each other, can be controlled, each of the control elements 11*b,* 11*d* being assigned to one of the brake circuits.

In the course of, for example, the so-called "half-load test", the car of the elevator installation 1 is first loaded with half the rated load. Then, by pressing the control elements 11*b,* 11*d,* both circuits of the operating brake of the elevator installation 1 are switched into the released position. By reference to the indicating devices 12, 13, it can now be checked whether the traction sheave or the elevator car of the elevator installation 1 remains at rest with the operating brake released. If this is the case, it can be assumed that the mass of the counterweight of the elevator installation 1 has been selected according to the regulations.

By pressing the control elements 11*c,* 11*e,* the feedback lines of the two travel contactors of the elevator installation 1 can be interrupted. These feedback lines serve in known manner the purpose of monitoring the functioning of the travel contactors, and in this respect form safety devices of the elevator installation 1. Indication of interruption of the feedback lines takes place by means of the indicating device 15.

In the course of, for example, the so-called "half-load test", the car of the elevator installation 1 is first loaded with half the rated load. Then, by pressing the control elements 11*b,* 11*d,* both circuits of the operating brake of the elevator installation 1 are switched into the released position. By reference to the indicating devices 12, 13, it can now be checked whether the traction sheave or the elevator car of the elevator installation 1 remains at rest with the operating brake released. If this is the Further control elements and/or indicating devices which are not shown can be arranged on the control unit 2. For example, for each switch or contact of the safety circuit a display element can be provided so that the condition of each switch of the safety circuit can be seen at a glance. Further displays of status or faults of functional units such as, for example, drive, doors, power supply, etc., or displays of status regarding inspection mode, travel direction, evacuation parameters, etc., can also be arranged on the control unit 2. Furthermore, control elements and/or indicating devices can be present which are specific to a particular order and relate only to the elevator in question. It is also possible for an interface for an electronic data carrier or a calculating element, such as a chip card or a computer, to be present, with which the control unit 2 can exchange data, passwords, parameters, programs, etc.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. An elevator installation, comprising: an elevator car; a main drive operative to move the elevator car; an auxiliary drive; an operating brake; and a device for operating the elevator installation in an evacuation mode when the elevator car is stuck and not moved by the main drive, the device having at least one control element for electrically controlling the auxiliary drive and the brake so as to raise and lower the elevator car, and at least one indicating device assigned to the auxiliary drive which indicates movement condition, direction and position of the elevator car so as to be perceivable by an operator of the control element, the at least one indicating device being operative to indicate position of the car relative to a floor landing, the at least one control element and the at least one indicating device being arranged locationally independent of at least one of the elevator installation and the auxiliary drive of the elevator installation.

2. An elevator installation according to claim 1, wherein the operating device further includes at least one of a control element for controlling the power supply of the elevator installation, a control element for controlling the main drive of the elevator installation, a control element for controlling a door drive of a means of conveyance of the elevator installation, a control element for controlling a safety device of the elevator installation, a control element for controlling lighting of a car of the elevator installation, and a control element to control lighting of a hoistway of the elevator installation, each of the control elements being respectively connected to one of the indicating devices.

3. An elevator installation according to claim 2, wherein the at least one indicating device includes at least one of an indicating device indicating the switching condition of the power supply of the elevator installation, an indicating device indicating an adjustment condition of a drive control device, an indicator device indicating an operating condition of the safety device of the elevator installation, an indicating device indicating the opening condition of the doors of the means of conveyance of the elevator installation, an indica ting device indicating a switching condition of lighting of the car of the elevator installation, and an indicating device indicating the switching condition of lighting of the hoistway of the elevator installation.

4. An elevator installation according to claim 2, wherein a number of the control elements are collected together in one location.

5. An elevator installation according to claim 4, wherein all the control elements are collected together in one location.

6. An elevator installation according to claim 1, and further comprising a control unit, the at least one control element being collected together with the at least one allocated indicating device in one location in the control unit.

7. An elevator installation according to claim 6, wherein one of the control element and the control unit is lockable.

8. An elevator installation according to claim 1, and further comprising a wired control device provided at least one of between the control element and the functional unit of the elevator installation and between the functional unit and the indicating device for controlling at least one functional unit of the elevator installation and for controlling at least one indicating device.

* * * * *